US010405652B2

(12) United States Patent
Gerber et al.

(10) Patent No.: US 10,405,652 B2
(45) Date of Patent: Sep. 10, 2019

(54) INSTALLATION PROCEDURE AND DESIGN FOR COLUMNS FULLY INTEGRATED PRODUCT

(71) Applicant: WHIRLPOOL CORPORATION, Benton Harbor, MI (US)

(72) Inventors: Byron Gerber, Roanoke, IL (US); Chad Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 312 days.

(21) Appl. No.: 15/244,029

(22) Filed: Aug. 23, 2016

(65) Prior Publication Data

US 2018/0055228 A1 Mar. 1, 2018

(51) Int. Cl.
*A47B 77/08* (2006.01)
*A47B 96/20* (2006.01)

(52) U.S. Cl.
CPC ..... *A47B 77/08* (2013.01); *A47B 2096/208* (2013.01)

(58) Field of Classification Search
CPC ..... A47B 77/08; A47B 2096/208
See application file for complete search history.

(56) References Cited

U.S. PATENT DOCUMENTS

| | | | | |
|---|---|---|---|---|
| 5,853,838 | A | 12/1998 | Siems et al. | |
| 6,155,004 | A | 12/2000 | Earhart et al. | |
| 6,494,551 | B1 | 12/2002 | Markley | |
| 8,382,219 | B2 | 2/2013 | Hottmann et al. | |
| 2007/0113377 | A1* | 5/2007 | Brachert | E05D 7/04 16/247 |
| 2015/0016907 | A1 | 1/2015 | Frick | |

* cited by examiner

*Primary Examiner* — Moshe Wilensky
(74) *Attorney, Agent, or Firm* — Price Heneveld LLP

(57) ABSTRACT

A method for positioning and installing a column product includes coupling a template to a first side and a second side of an opening, using the template to position a depth gauge to the first side and the second side of the opening, selecting at least one shim from a plurality of thickness regions comprising a first thickness of 0.050 inches, a second thickness of 0.10 inches, a third thickness of 0.15 inches, a forth thickness of 0.20 inches, and a fifth thickness of 0.25 inches, using the template to position the plurality of shims to the first side and the second side of the opening, positioning the column product into the opening, and attaching one or more fasteners to the column product and coupling the column product to the first side and the second side of the opening.

13 Claims, 5 Drawing Sheets

INSTALLATION PROCEDURE AND DESIGN FOR COLUMNS FULLY INTEGRATED PRODUCT

FIELD OF THE DISCLOSURE

The present disclosure generally relates to a method for positioning and installing a column product, and more particularly, the use of an installation guide for positioning and installing a column product into cabinetry.

BACKGROUND OF THE DISCLOSURE

In a typical domestic or industrial setting, an appliance is often surrounded by cabinetry, other fixtures, or furniture. In some cases it may be desirable for the appliance to be "integrated" with or "built into" its surrounding environment in order to diminish or obscure its presence. In some cases, cosmetic panels are used to blend an appliance into its surroundings (e.g., same/similar finish/exterior, same/similar detailing, corresponding orientation/positioning, etc.) to provide a more coherent, uniform aesthetic. When integrating the appliance into its surrounds, it may also be desirable to control the clearance (e.g., distance, spaces, etc.) between the appliance and the adjacent cabinetry for a desirable appearance. Similarly, it is desirable for the appliance to be coplanar with the surrounding cabinetry, including having the proper front-to-back alignment/registration in its installed position.

Many known and currently used installation systems and methods have several disadvantages, including, but not limited to, insufficient blending of the appliance with its surroundings, improper front-to-back alignment improper top-to-bottom and/or side to side alignment with surrounding cabinetry. One main disadvantage of many known installation systems and methods is the lack of ability to make positioning adjustments to the cosmetic panel relative to the doors, drawers, and other compartments and surfaces of the appliance both during installation and after installation. In many cases the initial coupling of the cosmetic panel or door to the appliance may not result in the panel being in the most desirable location relative to the surrounding cabinetry or environment.

SUMMARY

According to one aspect of the present disclosure, a method for positioning and installing a column product is provided. The method includes coupling a template to a first side and a second side of an opening, measuring a top opening width between a first top template location and a second top template location, measuring a top column width between an outside edge of a first top feature and the outside edge of a second top feature, selecting at least one top shim from a variable thickness shim having a shim thickness equal to a spacing between the column product and the first side and the second side of the opening, positioning the at least one top shim in a top shim location on the template, measuring a bottom opening width between a first bottom template location and a second bottom template location, measuring a bottom column width between the outside edge of a first bottom feature and the outside edge of a second bottom feature, selecting at least one bottom shim from the variable thickness shim having the shim thickness equal to the spacing between the column product and the first and second sides of the opening, positioning the at least one bottom shim in a bottom shim location on the template, positioning the column product into the opening, and attaching one or more fasteners to at least one of the first top feature, the second top feature, the first bottom feature, and/or the second bottom feature.

According to another aspect of the present disclosure, a method for positioning and installing a column product is provided. The method includes coupling a template to a first side and a second side of an opening, using the template to position a depth gauge to the first side and the second side of the opening, selecting at least one shim from a plurality of thickness regions comprising a first thickness of 0.050 inches, a second thickness of 0.10 inches, a third thickness of 0.15 inches, a forth thickness of 0.20 inches, and a fifth thickness of 0.25 inches, using the template to position the plurality of shims to the first side and the second side of the opening, positioning the column product into the opening, attaching one or more fasteners to the column product and coupling the column product to the first side and the second side of the opening.

According to another aspect of the present disclosure, an installation guide for positioning and installing a column product is provided. The installation guide includes a template to be coupled to at least one side of an opening, one or more shims having a plurality of thickness regions wherein the plurality of thickness regions are separated by a breaking geometry, a depth gauge to be coupled to the at least one side of the opening, and at least one fastener to couple the column product to the opening.

These and other features, advantages, and objects of the present device will be further understood and appreciated by those skilled in the art upon studying the following specification, claims, and appended drawings.

DETAILED DESCRIPTION OF EMBODIMENTS

Figure 1:
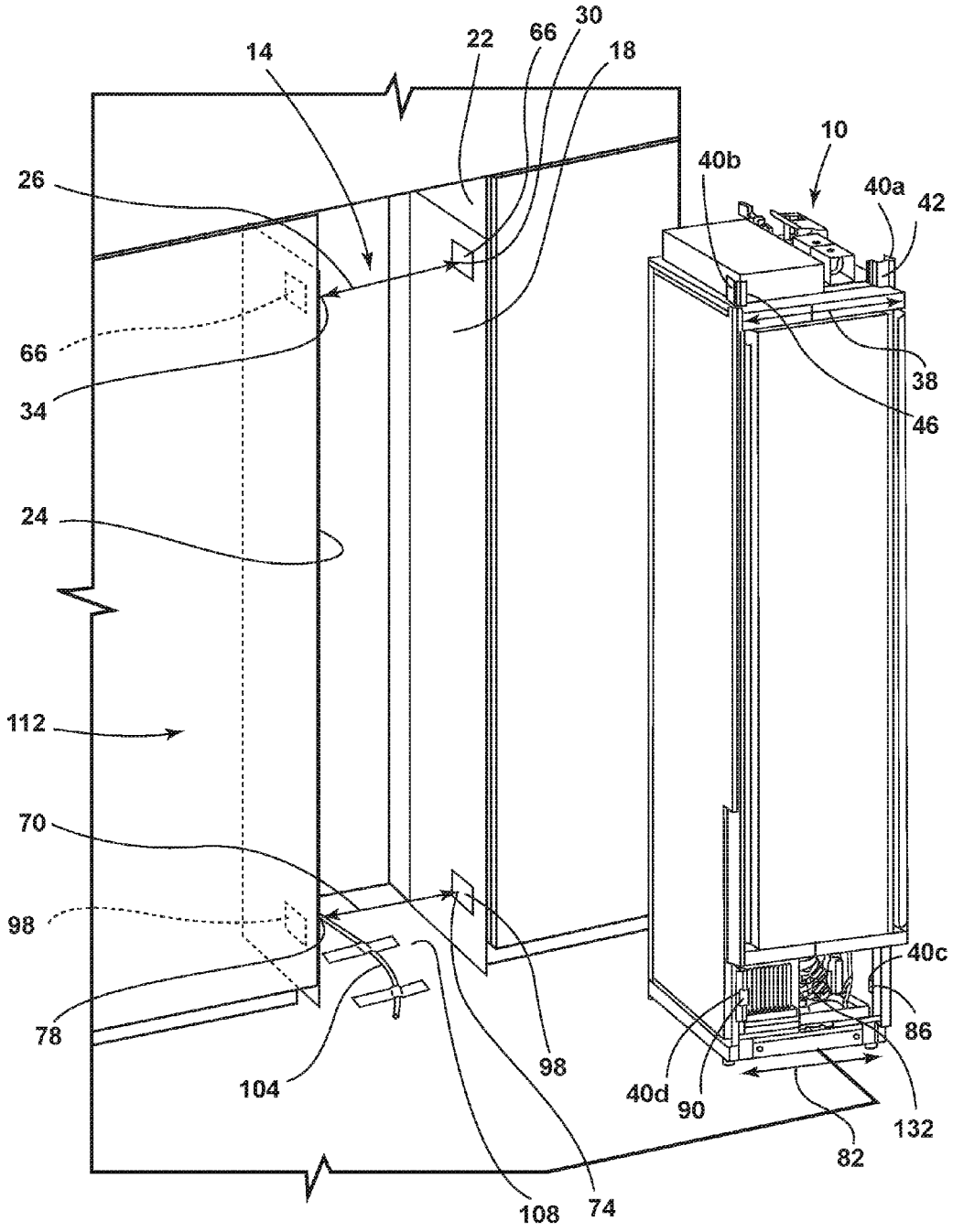
FIG. 1 is a front perspective view of a column product and an opening for its installation.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-5, reference numeral 10 generally designates a column product that is positioned and installed in an opening 14 using a template 18 coupled to a first side 22 and a second side 24 of the opening 14. A top opening width 26 is measured between a first top template location 30 and a second top template location 34. A top column width 38 is measured between an outside edge 40*a* of a first top feature 42 and the outside edge 40*b* of a second top feature 46. At least one top shim 50*a* is selected from a variable thickness shim 54 having a shim thickness 58 equal to a spacing 62 between the column product 10 and the first 22 and second side 24 of the opening 14. The at least one top shim 50*a* is positioned in a top shim location 66 denoted by the use of the template 18. A bottom opening width 70 is measured between a first bottom template location 74 and a second bottom template location 78. A bottom column width 82 is measured between the outside edge 40*c* of a first bottom feature 86 and the outside edge 40*d* of a second bottom feature 90. At least one bottom shim 50*b* is selected from the variable thickness shim 54 having the shim thickness 58 equal to the spacing 62 between the column product 10 and the first 22 and second sides 24 of the opening 14. The at least one bottom shim 50*b* is positioned in a bottom shim location 98 denoted by the template 18. The column product 10 is then positioned into the opening 14 and is attached to the first side 22 and the second side 24 by attaching one or more fasteners 102 to at least one of the first top feature 42, the second top feature 46, the first bottom feature 86, and/or the second bottom feature 90.

With reference to FIG. 1, the column product 10 is positioned in front of the opening 14 in a cabinet 112 for installation. An installation guide will provide the following steps to determine the proper shim thickness 58 (FIG. 2) for proper column product 10 installation. The template 18 is coupled to the first side 22 and the second side 24 of the opening 14. The template 18 is a member that can be applied to the first and second sides 22, 24 of the opening 14. In some embodiments, the template 18 can be constructed from paper, paperboard, plastic film, cardboard, or any other material known in the art that can be applied to the first and second sides 22, 24 of the opening 14. At locations marked by the template 18, the top opening width 26 is measured between the first top template location 30 and the second top template location 34. Next, the top column width 38 is measured for the column product 10 by measuring the distance between the outside edge 40*a* of the first top feature 42 and the outside edge 40*b* of the second top feature 46. The first and second top features 42, 46 on the column product 10 may be a corner bracket, a mounting bracket, a frame piece, a corner, a support edge, and/or any other mounting structure or feature on or proximate the top half of the column product 10. The bottom opening width 70 of the opening 14 is measured between the first bottom template location 74 and the second bottom template location 78 as marked by the template 18. The bottom column width 82 is measured between the outside edge 40*c* of the first bottom feature 86 and the outside edge 40*d* of the second bottom feature 90. The first and second bottom features 86, 90 on the column product 10 may be a corner bracket, a mounting bracket, a frame piece, corner, support edge, and/or any other mounting structure or feature on or proximate the top half of the column product 10. A water line 104 is positioned and taped to a bottom floor surface 108 during the installation and coupled to the column product after the column product is positioned into the opening 14.

Figure 2:
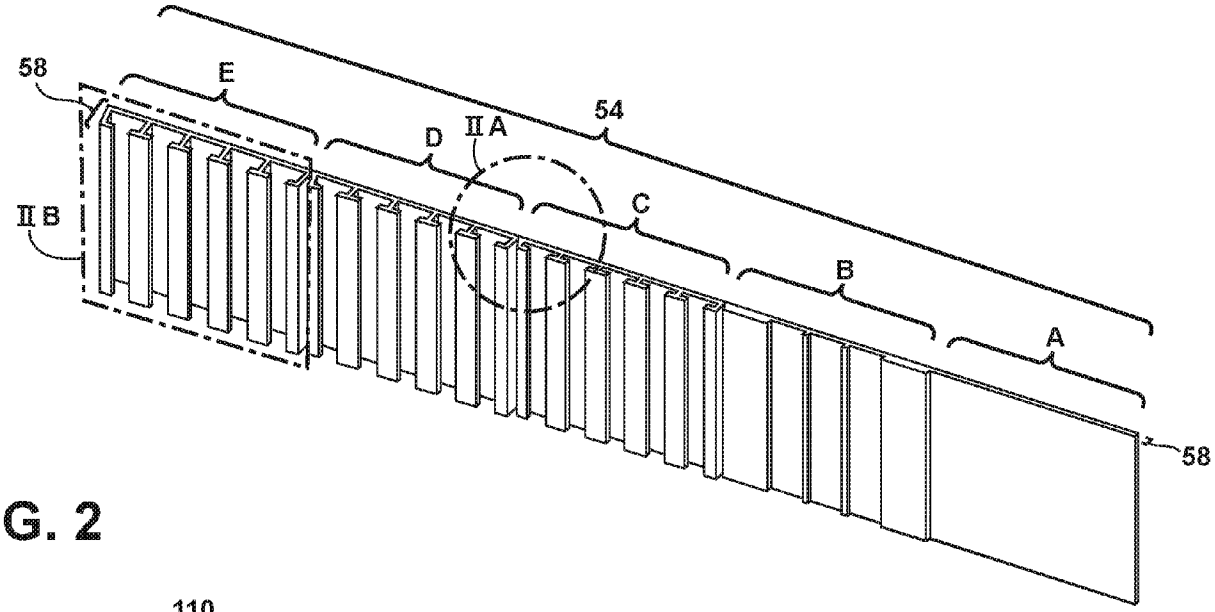
FIG. 2 is a front perspective view of a variable thickness shim according to one aspect.
Figure 2B:
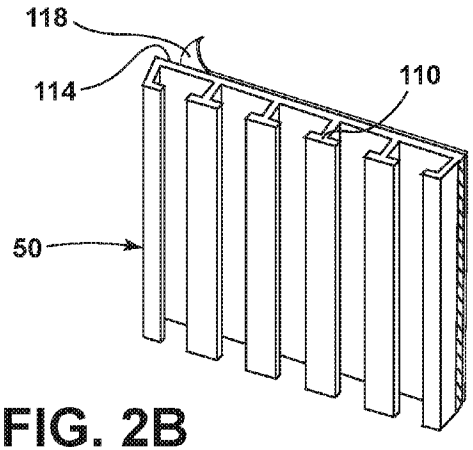
FIG. 2B is an expanded front perspective view of a single shim broken away from the variable thickness shim according to one aspect.

With reference to FIGS. 2-2B, the variable thickness shim 54 is shown having a plurality of different shim thicknesses 58 making up the length of each shim 50. The variable thickness shim 54 used with the installation of the column product 10 can be configured with a plurality of thickness regions. In some embodiments, the variable thickness shim 54 can have seven thickness regions, six thickness regions, five thickness regions, four thickness regions, or three thickness regions A-E. The different thickness regions are separated by a breaking geometry 116 which serves to score the shim 50 for easy breaking. The breaking geometry 116 has two spacing members 110 angled apart, where the two spacing members 110 can be bent in towards each other to touch and break a connecting smooth side 114 of the variable thickness shim 54. Each shim 50 can be broken away from the variable thickness shim 54 at one or two breaking geometry 116 locations. Once a proper shim thickness has been determined, that shim thickness 58 can be created by cracking off and using the appropriate regions. The smooth side 114 of the shim 50 may have a pressure sensitive tape 118 applied to the shim 50 to enable easy stacking of several thicknesses 58 and for adhesion to the first or second sides 22, 24 (FIG. 1) of the opening 14 (FIG. 1). The shims will be positioned in the opening 14 at locations marked by the template 18 (FIG. 1) where one or more fasteners 102 (FIG. 5) will be driven through the column product 10 to anchor the column product 10 to the side walls 22, 24 of the opening 14.

As also shown in FIG. 2, in some embodiments the variable thickness shim 54 has the plurality of shim thicknesses 58 where region A may have a first thickness of 0.050 inches, region B may have a second thickness of 0.10 inches, region C may have a third thickness of 0.15 inches, region D may have a fourth thickness of 0.20 inches, and region E may have a fifth thickness of 0.25 inches. The variable thickness shim 54 can be varied to any thickness or number of shim thicknesses 58 as required by the expected spacing to be filled by the shim depending on the given application. In some embodiments, the shims 50 may have the varying shim thicknesses 58 of A, B, C, D, or E listed above and may need to be coupled or stacked to obtain the desired spacing between the column product 10 and the first and/or second side 22, 24. For example, if a thickness of 0.35 inches is needed, the 0.10 inch and 0.25 inch shims could be stacked and used together in combination or the 0.15 and 0.20 inch shims could be stacked and used together in combination.

Figure 3:
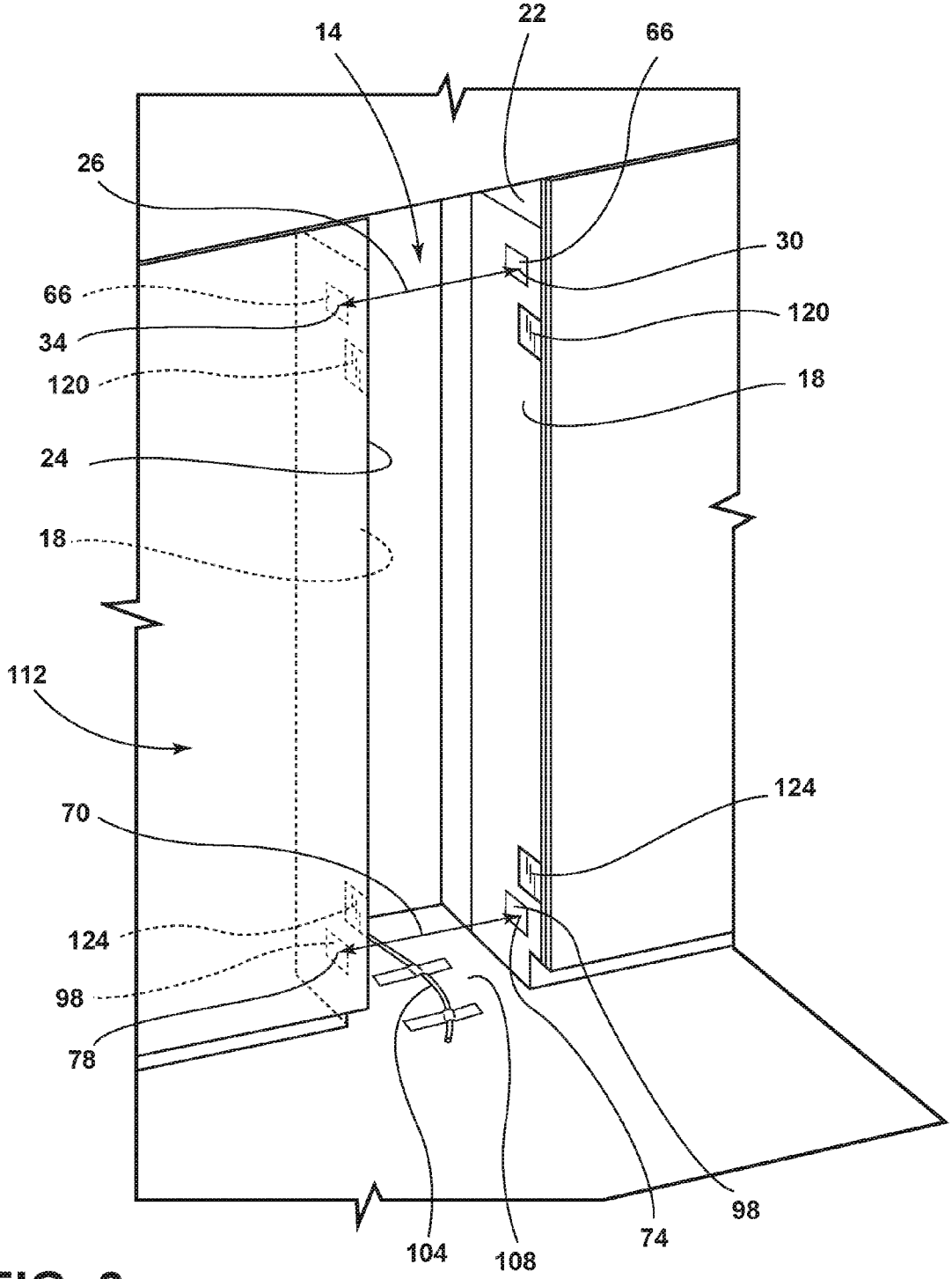
FIG. 3 is a front perspective view of an opening for the installation of the column product according to one aspect.

With reference to FIG. 3, the proper depth of the column product 10 (FIG. 1) within the opening 14 of the cabinetry 112 may be related to the thickness of the door panel and/or cosmetic panel that will be utilized. In some embodiments, the use of the template 18 to position a top depth gauge 120 and a bottom depth gauge 124 will allow an installer to estimate the proper depth to place the column product 10 appropriately based on the type of panel to be used. The top and bottom depth gauges 120, 124 are members that can be applied to the first and second sides 22, 24 of the opening 14. In some embodiments, the top and bottom depth gauges 120, 124 can be applied separately to the first and second sides 22, 24 of the opening 14 using the template 18 as guidance and in other embodiments the top and bottom depth gauges 120, 124 may be premanufactured as part of the template 18 itself so the template 18 incorporates the top and bottom depth gauges 120, 124 to make up the template 18. The top and bottom depth gauges 120, 124 can be constructed from paper, paperboard, plastic film, cardboard, or any other material known in the art that can be applied to the first and second sides 22, 24 of the opening 14. Since the doors and wood panels crafted for the variety of column products 10 frequently have a wide range of variability, the installer must consider the proper positioning or depth of the column product 10 into the cabinetry 112. In some embodiments, the top depth gauges 120 will be coupled to both the first side 22 and the second side 24 of the opening 14 in positions designated by the top of the template 18. Additionally, the bottom depth gauge 124 will also be coupled to the first side 22 and the second side 24 of the opening 14 near the bottom as designated by the template 18. The remaining steps for installation will follow those described above.

Figure 2A:
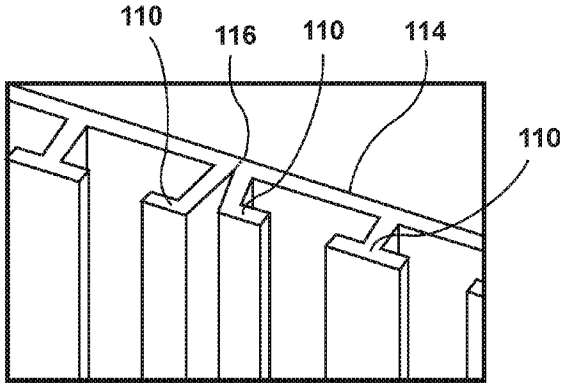
FIG. 2A is an enlarged view illustrating the breaking geometry of a variable thickness shim of FIG. 2, taken at area IIA.
Figure 4:
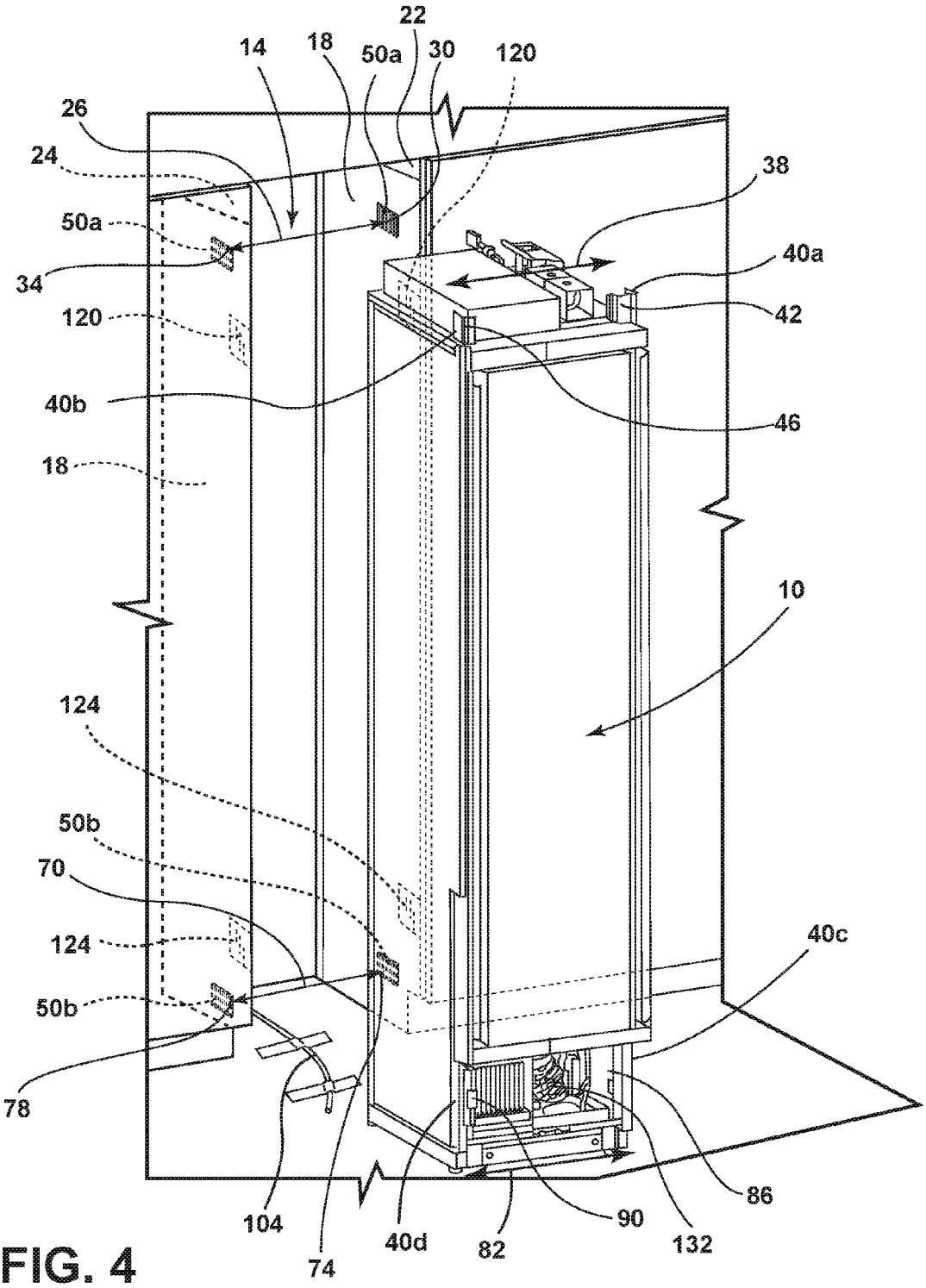
FIG. 4 is a front perspective view of the column product being installed into an opening according to another aspect.

Referring now to FIG. 4, proper orientation, alignment, and constraint of the column product 10 is reliant upon placement and selection of shims 50. An installation guide will provide the following steps to determine the proper shim thickness 58 (FIG. 2) for proper column product 10 installation. The template 18 is coupled to the first side 22 and the second side 24 of the opening 14. At locations marked by the template 18, the top opening width 26 is measured between the first top template location 30 and the second top template location 34. Next, the top column width 38 is measured for the column product 10 by measuring the distance between the outside edge 40 of the first top feature 42 and the outside edge 40 of the second top feature 46. The bottom opening width 70 of the opening 14 is measured between the first bottom template location 74 and the second bottom template location 78 as marked by the template 18. The bottom column width 82 is measured between the outside edge 40 of the first bottom feature 86 and the outside edge 40 of the second bottom feature 90. In some embodiments, the shim 50 to be provided with the product will be configured with five thickness regions. The five thickness regions are separated by the breaking geometry 116 (FIG. 2A) which serves to score the part for easy breaking. Once the proper shim thickness 58 has been determined, the desired thickness can be created by cracking off and using the appropriate regions of the shim 50 using the breaking geometry 116. The smooth side 114 (FIG. 2A) of the shim may have a pressure sensitive tape 118 (FIG. 2B) applied to it to enable easy stacking of several shim thicknesses 58 and/or for adhesion to the sides 22, 24. These shims 50 will be positioned in the template 18 at locations proximate to where one or more fasteners 102 (FIG. 5) will be driven through the top and bottom features 42, 46, 86, 90 to anchor the column product 10 to the first and second sides 22, 24 of the opening 14. The selected shims 50 will be positioned using the template 18, as shown in FIG. 4.

In some embodiments, the installation guide can provide the following steps to determine the proper shim thickness 58 for proper column product 10 installation: 1) at the first and second top template locations 30, 34 marked by using the template 18, measure the top opening width 26 and record this value; 2) measure the top column width 38 from the outside edge of the first top feature 42 and the outside edge of the second top feature 46; 3) determine the proper shim thickness 58 for the top using the following math: (top opening 26–top column width 38)/2–1/32=shim thickness required; 4) this is the correct shim thickness 58 for each side at the top. Create the proper thickness using the variable thickness shim 54 provided, breaking the shims 50 at the breaking geometry 116 locations and stacking if needed; 5) position the top shims 50*a* in the locations identified by the template 18; 6) at the first and second bottom template locations 74, 78 marked by using the template 18, measure the bottom opening width 70 and record this value; 7) measure the bottom column width 82 from the outside edge of the first bottom feature 86 and the outside edge of the second bottom feature 90; 8) determine the proper shim thickness 58 for the top using the following math: (bottom opening with 70–bottom column width 82)/2–1/32=shim thickness required; 9) this is the correct shim thickness 58 for each side at the bottom. Create the proper thickness 58 using the variable thickness shim 54 provided, breaking the shims 50 at the breaking geometry 116 locations and stacking; 10) position the bottom shims 50*b* in the locations identified by the template 18; 11) roll the column product 10 into the opening 14 to a depth.

Figure 5:
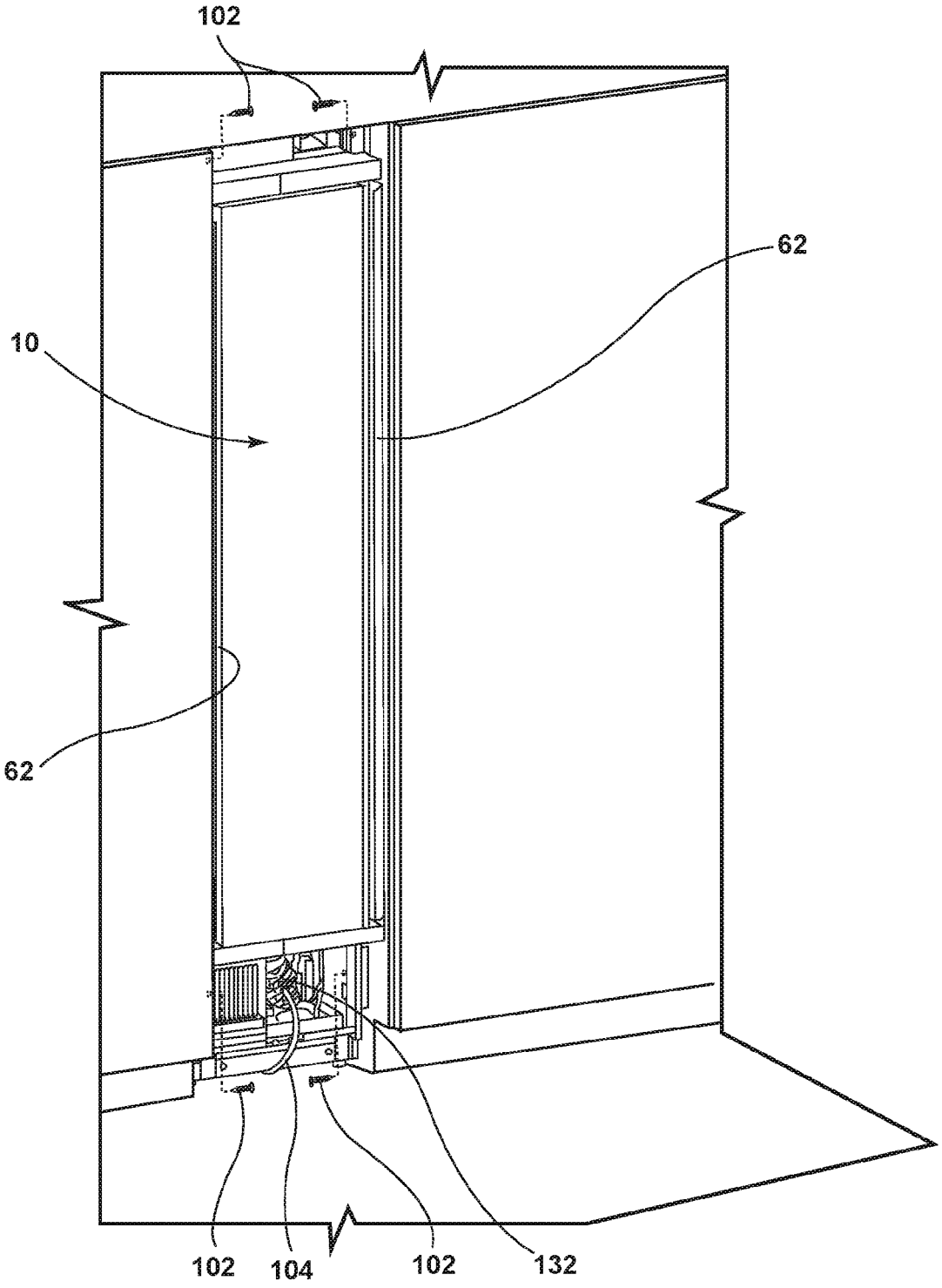
FIG. 5 is a front perspective view of the column product installed in an opening according to another aspect.

Referring to FIG. 5, in other embodiments, the following steps will be taken to finish the installation of the column product 10: 1) one or more fasteners 102 provided with the column product 10 can be driven in the first and second top features 42, 46 and bottom features 86, 90 previously addressed with shims 50 selection; 2) the top and bottom depth gauges 120, 124 (FIG. 3), having been referenced for depth, may be removed; 3) the waterline 104 will be un-taped from the floor, secured to a column waterline (not shown), and stowed in a machine compartment (not shown); 4) an air grill (not shown) can be positioned over a machine compartment opening 132; 5) the column product 10 having been anchored, the installation guide can recommend placing significant load in the door and for the door to be cycled in order to encourage the door to sag, or relax prior to a cosmetic door panel (not shown) being installed; 6) the cosmetic door panel can be attached to the column product 10; 7) side trims (not shown) of the column product 10 can be fastened to the side walls 22, 24 of the opening 14; 9) side trims can be secured to conceal the one or more fasteners 102 and structural members of the door and column product 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for positioning and installing a column product, the method comprising steps of:

coupling a template to a first side and a second side of an opening;

measuring a top opening width between a first top template location and a second top template location;

measuring a top column width between an outside edge of a first top feature and an outside edge of a second top feature;

selecting at least one variable thickness shim as a top shim having a top shim thickness substantially equal to a spacing between the column product and the first side and the second side of the opening, wherein the variable thickness shim has a smooth side with an easily removable pressure sensitive tape to enable stacking of several variable thickness shims and to enable adhesion of the variable thickness shim to the first and second sides;

positioning the at least one top shim in a top shim location on the template;

measuring a bottom opening width between a first bottom template location and a second bottom template location;

measuring a bottom column width between an outside edge of a first bottom feature and an outside edge of a second bottom feature;

selecting at least one variable thickness shim as a bottom shim having a bottom shim thickness equal to the spacing between the column product and the first and second sides of the opening, wherein the variable thickness shim has a smooth side with an easily removable pressure sensitive tape to enable stacking of the variable thickness shims and to enable adhesion of the variable thickness shim to the first and second sides;

positioning the at least one bottom shim in a bottom shim location on the template;

positioning the column product into the opening; and attaching one or more fasteners to at least one of the first top feature, the second top feature, the first bottom feature, and/or the second bottom feature.

2. The method of claim 1, further comprising:

forming a plurality of thickness regions.

3. The method of claim 2, further comprising:

separating the plurality of thickness regions of the first and the second variable thickness shims by applying a force at a breaking geometry.

4. The method of claim 2, further comprising:

forming five thickness regions in the variable thickness shim.

5. The method of claim 3, further comprising:

applying the force at an opposingly angled spacing member of the breaking geometry.

6. The method of claim 1, further comprising:

positioning and taping a waterline to a bottom floor surface; and coupling the waterline to the column product after positioning the column product into the opening.

7. The method of claim 1, further comprising:

utilizing the template to position a depth gauge relative to the first side and the second side of a cabinet.

8. The method of claim 7, further comprising:

determining a proper depth utilizing the depth gauge; and coupling a covering to the column product based on the determined proper depth.

9. A method for positioning and installing a column product, the method comprising:

coupling a template to a first side and a second side of an opening;

using the template to position a depth gauge to the first side and the second side of the opening;

selecting at least one shim from a plurality of thickness regions comprising a first thickness of 0.050 inches, a second thickness of 0.10 inches, a third thickness of 0.15 inches, a forth thickness of 0.20 inches, and a fifth thickness of 0.25 inches;

using the template to position the plurality of shims to the first side and the second side of the opening, wherein the at least one shim has a smooth side with an easily removable pressure sensitive tape to enable stacking of the variable thickness shims and adhesion to the first side and the second side;

positioning the column product into the opening; and attaching one or more fasteners to the column product and coupling the column product to the first side and the second side of the opening.

10. The method of claim 9, further comprising:

separating the plurality of shim thickness regions at angled spacing members of a breaking geometry.

11. The method of claim 9, further comprising:

positioning and taping a waterline to a bottom floor surface during installation; and coupling the waterline to the column product after the column product is positioned into the opening.

12. The method of claim 9, further comprising:

using the template to position a depth gauge to the first side and the second side of the opening.

13. The method of claim 9, further comprising:

coupling a covering to the column product using the depth gauge.

* * * * *